US005636126A

United States Patent [19]

Heaven et al.

[11] Patent Number: 5,636,126

[45] Date of Patent: Jun. 3, 1997

[54] PROCESS FOR TRANSFORMING A HIGH RESOLUTION PROFILE TO A CONTROL PROFILE BY FILTERING AND DECIMATING DATA

[75] Inventors: Edwin M. G. Heaven, North Vancouver; Christopher B. Lynch, Burnaby; Par O. A. Hallman, North Vancouver, all of Canada

[73] Assignee: Measurex Devron, Inc., North Vancouver, Canada

[21] Appl. No.: 506,022

[22] Filed: Jul. 24, 1995

[51] Int. Cl.[6] ..... G06F 19/00

[52] U.S. Cl. ..... 364/471.03; 364/572; 73/159

[58] Field of Search ..... 364/471.01–471.03, 364/472.06, 472.1, 472.12, 472.13, 572, 568, 178, 179; 250/559.48; 73/159; 162/DIG. 10, 198, 252, 253, 262, 263

[56] References Cited

U.S. PATENT DOCUMENTS

| | | | |
|---|---|---|---|
| 4,680,089 | 7/1987 | Aral et al. | 364/471.03 |
| 4,707,779 | 11/1987 | Hu | 364/471.03 |
| 4,903,528 | 2/1990 | Balakrishnan et al. | 73/159 |
| 4,947,684 | 8/1990 | Balakrishnan | 73/159 |
| 4,965,736 | 10/1990 | Balakrishnan | 364/471.03 |
| 4,982,334 | 1/1991 | Balakrishnan | 364/471.03 |
| 5,121,332 | 6/1992 | Balakrishnan et al. | 364/471.01 |
| 5,566,093 | 10/1996 | White | 364/572 |

OTHER PUBLICATIONS

W. L. Bialkowski and Alan D. Weldon; The Digital future of process control; possibilities, limitations, and ramifications; Oct. 1994; pp. 69–75; vol. 77, No. 10 Tappi Journal; Technical Association of the pulp and paper industry.

*Primary Examiner*—Paul P. Gordon
*Assistant Examiner*—Steven R. Garland
*Attorney, Agent, or Firm*—Medlen & Carroll, LLP

[57] ABSTRACT

A process for transforming a plurality of data points n defining a high resolution profile for a parameter of a sheet material being manufactured into a low resolution profile for control of the parameter is disclosed. The process involves filtering the data points of the high resolution profile using an anti-aliasing filter function to create an intermediate profile and reducing the number of datapoints of the intermediate profile by an integer factor to create the low resolution profile to be used to control the parameter.

8 Claims, 5 Drawing Sheets

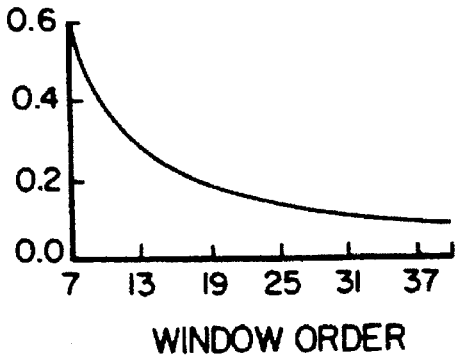
FIG. 4a
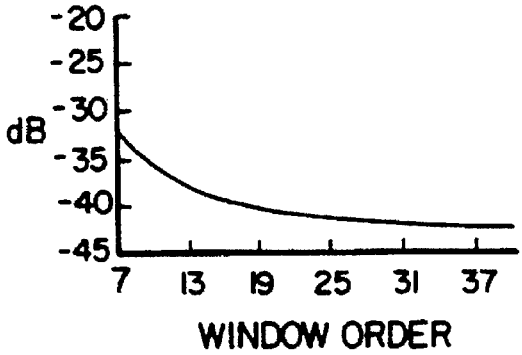
FIG. 4b
FIG. 5a
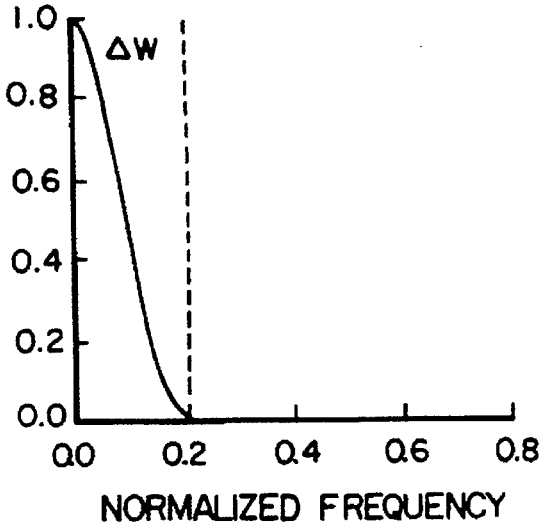
FIG. 5b
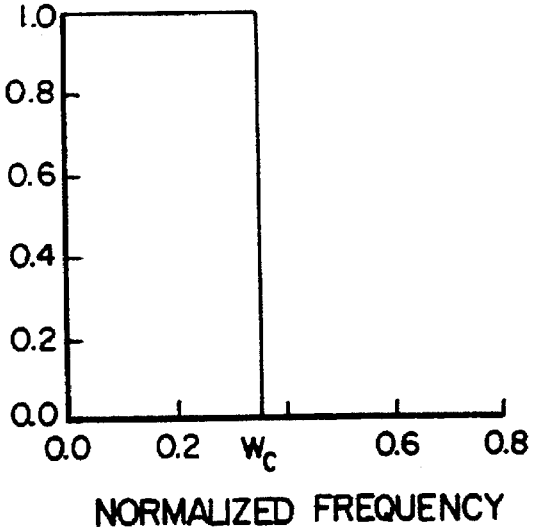

PROCESS FOR TRANSFORMING A HIGH RESOLUTION PROFILE TO A CONTROL PROFILE BY FILTERING AND DECIMATING DATA

FIELD OF THE INVENTION

This invention relates to a process for controlling various characteristics of sheet material manufactured on papermaking equipment by filtering data gathered about characteristics and controlling the characteristic based on the filtered data.

BACKGROUND OF THE INVENTION

In the production of sheet materials such as paper, it is necessary to control certain properties of the sheet material. Properties such as basis weight, moisture and caliper will vary along the machine direction which is the path in which the sheet material is moved during production, and these properties will also vary in the cross machine direction which is perpendicular to the machine direction.

In order to control the paper parameters, the sheet material being manufactured must be accurately measured and data concerning the measured parameters used to alter the process to maintain the parameters within desired limits. Collection of samples from scanning measurement systems which traverse the sheet perpendicular to its travel result in the establishment of a high resolution profile. These high resolution profiles are transformed by filtering into a control profile that is used to control actuators that adjust the parameters of the sheet material in a feedback loop.

For example, in order to control sheet thickness in the cross machine direction, calendering machines are used comprising a series of rolls arranged in parallel, one above the other, in a stack. The sheet material is trained through the stack to pass through the nip areas between adjacent rolls. Calender profile actuators are used to adjust the thickness parameter of the sheet material. The profile actuators comprise a plurality of devices that operate to heat or cool the rolls differentially along their length. Each heating or cooling device controls a zone or "slice" of a roll. For example, when a slice of the roll is heated, the diameter of the roll increases and the caliper of the sheet material in that slice is decreased. The caliper of the sheet material downstream of the rolls is monitored by a scanning sensor that collects a plurality of datapoints in the cross machine direction. These datapoints define a high resolution or mini-slice profile of the thickness of the paper sheet. The profile is provided to a profile analyser as a signal indicative of the caliper thickness. The signal is transformed by the profile analyser into a low resolution control profile. The control profile is divided into a plurality of control slices, each control slice being used to adjust a particular actuator to correct for any variation in caliper thickness from a desired profile across the sheet material. Each control slice in the low resolution profile is derived from plurality of mini-slices in the high resolution profile. In other words, each datapoint in the control profile is derived from a plurality of datapoints in the high resolution profile.

Other sheet parameters are controlled in the same general manner. A high resolution profile of a parameter to be controlled is acquired by sensing equipment. The high resolution profile is then transformed into a low resolution control profile that provides control signals to actuators for adjusting the parameter being monitored.

In any control system that works along the foregoing lines, it is important that when the high resolution profile is transformed into the low resolution control profile the datapoints or signal be filtered to prevent aliasing in the control profile. The high resolution profile contains many different frequency components and when the high resolution profile is transformed to a low resolution profile that is aligned to the physical actuator dimensions, the higher frequency components can lead to a distortion of the control profile. Therefore, aliasing is the creation of sampling induced fictitious components that are added to signal content. As a result, control actions can be made on "phantom" variation which does not exist in the original high resolution profile.

SUMMARY OF THE INVENTION

Applicant has developed a process for filtering and decimating a high resolution profile to produce a low resolution control profile that is an accurate representation of the high resolution profile.

Accordingly, the present invention provides a process for transforming a plurality of data points, n, defining a high resolution profile for a parameter of a sheet material being manufactured into a low resolution profile for control of the parameter comprising the steps of:

filtering the data points of the high resolution profile using an anti-aliasing filter function to create an intermediate profile; and reducing the number of datapoints of the intermediate profile by an integer factor to create the low resolution profile to be used to control the parameter.

In a further aspect the present invention provides a process for controlling a parameter of a sheet material which is being manufactured comprising the steps of:

(a) causing the sheet material to travel;

(b) moving a scanning means across the sheet;

(c) measuring a parameter of the sheet with the scanning means in a plurality of zones, n, which are disposed side-by-side across the sheet to produce a plurality of data points that define a high resolution or mini-slice profile;

(d) filtering the data points using an anti-aliasing filter function to produce an intermediate profile;

(e) reducing the number of data points by an integer factor to create a low resolution or control profile; and (f) controlling the parameter based upon the low resolution profile.

The processes of the present invention rely on an anti-aliasing filter to remove high frequency components in the high resolution profile. Then, single or multi-stage decimation is performed to construct a profile for cross machine direction control of a sheet parameter.

The processes of the present invention provide a faithful reproduction of the appropriate frequency components in the high resolution profile into the low resolution control profile thereby permitting improved control performance of the parameter actuators.

BRIEF DESCRIPTION OF THE DRAWINGS

Aspects of the present invention are illustrated, merely by way of example, in the accompanying drawings in which:

FIGS. 4*a* and 4*b* are graphs showing the effect of Hamming function window order N on the transition band and the attenuation, respectively;

FIGS. 5*a* and 5*b* are graphs showing the magnitude responses of a Hamming filter and an ideal low pass filter, respectively.

DESCRIPTION OF THE PREFERRED EMBODIMENTS

Figure 1:
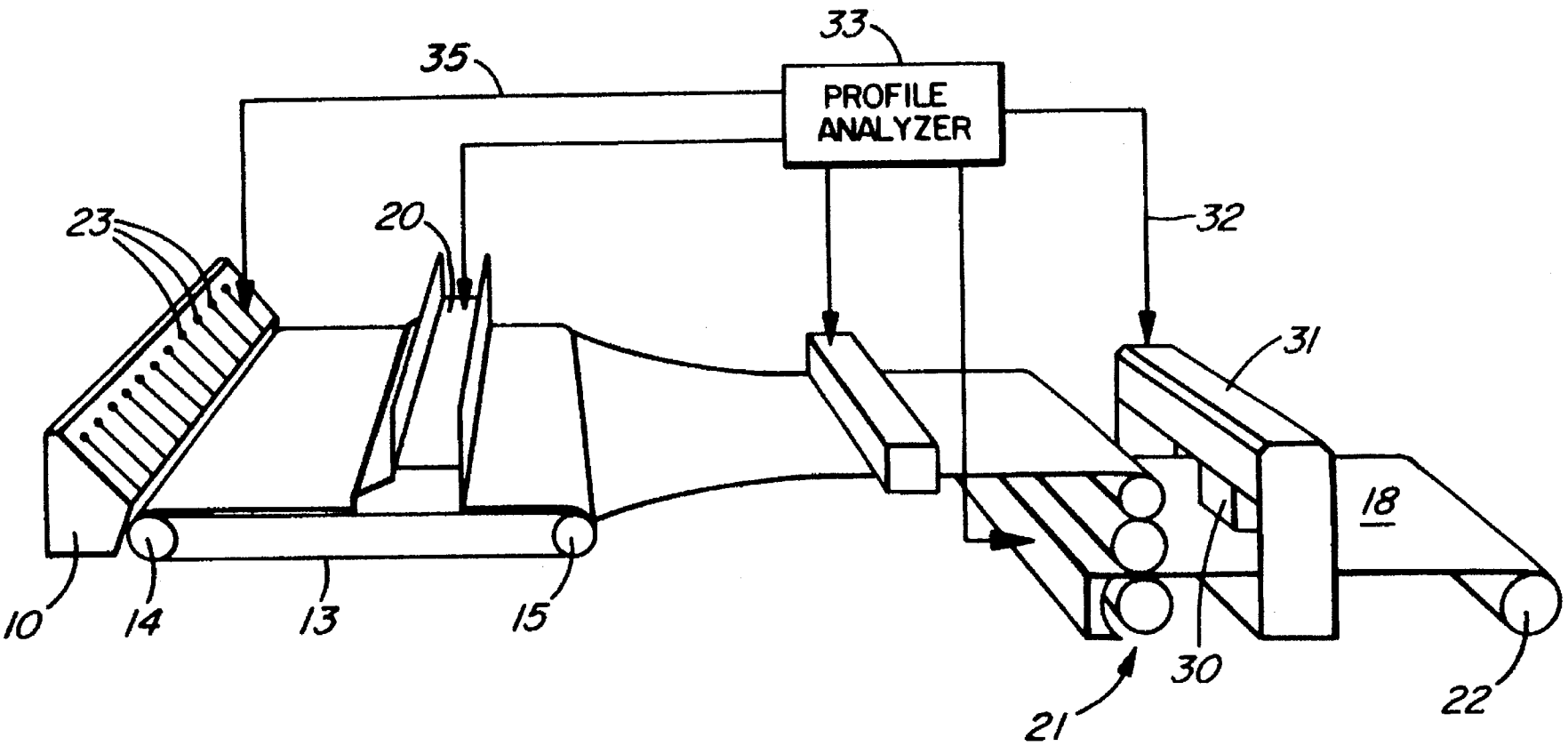
FIG. 1 is a generally schematic view of an example of a sheetmaking machine.

Referring to FIG. 1, there is shown a sheetmaking machine for producing continuous sheet material. In the illustrated embodiment, the sheet making machine includes a feed box 10 which discharges raw material, such as paper pulp, onto a supporting web 13 trained between rollers 14 and 15. Further, the sheetmaking machine includes processing stages, such as a steambox 20 and calendering device 21 which operate upon the raw material to produce a finished sheet 18 which is collected on reel 22.

In conventional sheetmaking practice, the processing stages along the machine of FIG. 1 each include actuators for controlling parameters of sheet 18. In the illustrated embodiment, for instance, feed box 10 includes independently adjustable actuators 23 which control the quantity of material fed onto web 13 at adjacent cross-directional locations referred to as "slices". Similarly, steambox 20 includes actuators that control the quality of steam applied to sheet 18 at various slice locations. Also, calendering stage 21 can include actuators for controlling the compressive pressure applied to sheet 18 at various slice locations. In the following discussion, the various actuators are referred to as profile actuators as they affect the cross-directional profile of the sheet material being produced.

To provide control information for operating the profile actuators on the sheetmaking machinery of FIG. 1 at least one scanning sensor 30 is mounted on the sheetmaking machine to measure a selected sheet property, such as caliper or basis weight, during production of the sheet material. In the illustrated embodiment, scanning sensor 30 is mounted on a supporting frame 31 that extends across the sheetmaking machine in the cross direction. Further, scanning sensor 30 is connected, as by line 32, to a profile analyzer 33 for providing the analyzer with signals indicative of the magnitude of the measured sheet parameter at various cross directional measurement or data points. The signals form the high resolution profile. Profile analyzer 33 transforms the high resolution or mini-slice profile into a low resolution control profile. Profile analyzer 33 is also connected to the profile actuators at the processing stages of the sheetmaking machine for providing control signals to the actuators based on the low resolution control profile. For example, line 35 carries control signals from the profile analyzer 33 to profile actuators 23 at feedbox 10.

Figure 2:
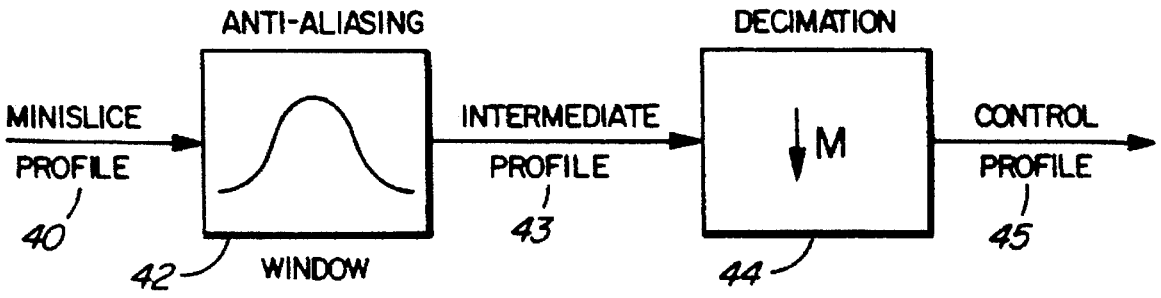
FIG. 2 is a block diagram showing the process of the present invention involving applying an anti-aliasing filter to the minislice profile and then decimating the resulting intermediate profile to produce a control profile.

The process of the present invention is directed to performing the transformation of the high resolution profile to the low resolution profile in such a manner as to provide a faithful reproduction of the appropriate frequency components in the high resolution profile into the low resolution control profile. FIG. 2 is a block diagram showing the steps of the process of the present invention. In the process of the present invention, the datapoints, n, of the high resolution mini-slice profile 40 are filtered at 42 using an anti-aliasing filter function to create an intermediate profile 43. Then, the number of datapoints of the intermediate profile are reduced by an integer factor M at 44 to create the low resolution profile 45 to be used to control the parameter. The decimation factor M is based on the number of profile actuators. The technique shown at 44 is known as decimation or downsampling of the intermediate profile.

Figure 3:
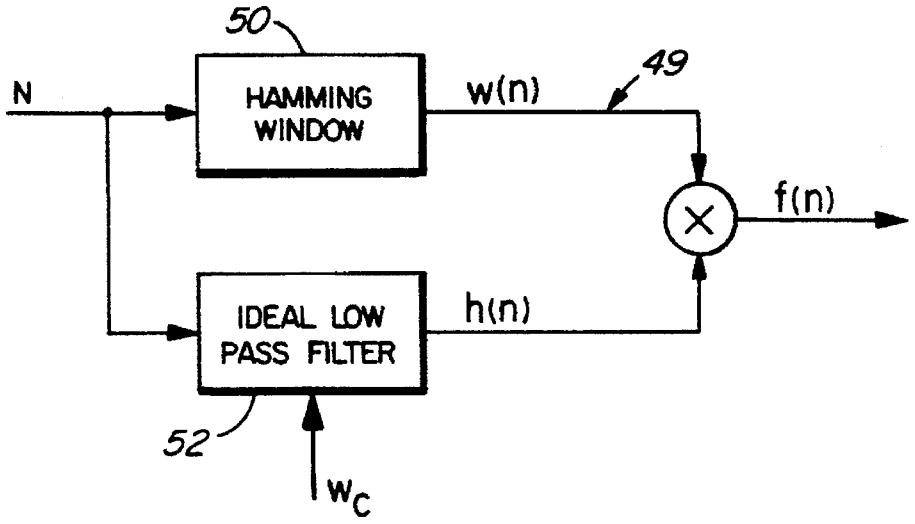
FIG. 3 is a block diagram of the anti-aliasing filter flow according to the present invention.

In the process of the present invention, the anti-aliasing filter step 42 is needed to ensure that no high frequency components in the high resolution profile are mapped into the low resolution control profile as phantom low frequency components. Applicant has developed an anti-aliasing filter that is particularly effective in accomplishing this goal. FIG. 3 is a block diagram detailing the anti-aliasing filter flow of the present invention.

The anti-aliasing filter 49 is constructed using a Hamming filter function 50 and an ideal low pass filter function 52. In accordance with standard terminology, the Hamming filter function is also referred to as a "window" function or simply a "window".

As shown in FIG. 3, the anti-aliasing filter is designed by first selecting an order N for Hamming window 50. FIGS. 4*a* and 4*b* are graphs that can be used to aid in the choice of window order. The graphs provide the user with an idea of the effect of choosing different window orders as the window order sets the width of the resulting filter's transition band and the attenuation of the stopband. The stopband defines the region where unwanted components are significantly attenuated.

The Hamming window response is convolved with an ideal low pass filter response as shown in FIG. 3. The Hamming window coefficients are determined according to the following equation:

$$w(n) = .54 - .46\cos\frac{(2\pi n)}{N} \qquad 0 \leqq n \leqq N$$
$$= 0 \qquad \text{otherwise}$$

where N=the window order of the Hamming function.

The coefficients for the ideal low pass filter are determined by the equation:

$$h(n) = \frac{\sin\left[\omega_c\left(n-\frac{N}{2}\right)\right]}{\pi\left(n-\frac{N}{2}\right)} \qquad \text{for } n \neq \frac{N}{2}$$
$$= \omega_c \qquad \text{for } n = \frac{N}{2}$$

where $\omega_c$ is the cutoff frequency defined as the frequency where magnitude is attenuated by fifty per cent. The cutoff frequency is related to the number of minislices per control slice (effectively, the number of datapoints n in the high resolution profile per datapoint in the final low resolution control profile). To avoid all chance of aliasing the cutoff frequency can be made equal to:

$$\omega_c = \frac{\text{\# of control profile data points}}{\text{\# of high resolution profile datapoints}}\pi - \frac{1}{2}(\Delta\omega)\pi$$

where $\Delta\omega$ is the transition band of the anti-aliasing filter.

Choosing the cutoff frequency in the above manner ensures that no aliasing will occur. However, the width of the transition band $\Delta\omega$ corresponding to the window order chosen must be known to determine $\omega_c$. Several other possible approaches may be used to determine the cutoff frequency of the anti-aliasing filter. One possibility would involve keeping the window order maximized to its largest value as the transition band will be at its narrowest and constant. Then $\omega_c$ can be easily evaluated as discussed above. Alternatively, the cutoff frequency $\omega_c$ can be set equal to the ratio of minislices per control zone. The drawback of this approach is that the width of the transition band may become a significant factor in some situations. Even if the Hamming window order is forty, the transition band may be too wide and the anti-aliasing filter could potentially allow some aliasing to occur. Regardless of which approach is taken, the anti-aliasing filter of the present invention will perform much better than applying only a rectangular window directly to the high resolution profile as done in conventional transformation schemes.

The anti-aliasing filter 49 of the present invention is constructed using the Hamming window coefficients and the coefficients from the ideal low pass filter. The anti-aliasing filter function f(n) is determined according to the following formula:

$$f(n)=w(n)h(n)$$

Hence, the coefficients of the anti-aliasing function are determined by multiplying together the Hamming window coefficients and the ideal low pass filter coefficients that were determined as described above.

The design of the anti-aliasing filter is automatic once the window order N is chosen as the coefficients for the Hamming window are based on N and the coefficients for the ideal low pass filter are based on the window order N and the number of minislices per control slice. Generally, a large N is better but this may be limited by computation or computer memory.

Figure 6:
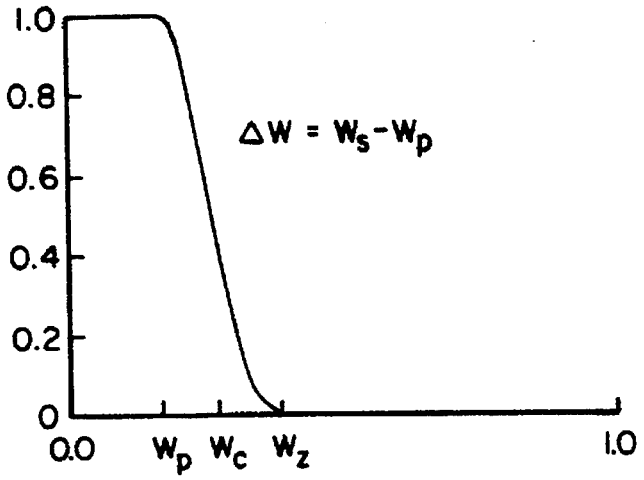
FIG. 6 is a graph showing the magnitude response of an anti-aliasing filter designed using the Hamming filter and ideal low pass filter of FIGS. 5*a* and 5*b*.

By way of example, FIGS. 5*a*, 5*b* are graphs showing the response of a 20the order Hamming function and an ideal low pass filter. FIG. 6 is a graph of an anti-aliasing filter constructed according to the present invention by convolving the Hamming window response of FIG. 5*a* and the low pass filter response of FIG. 5*b*.

As shown in FIG. 2, the anti-aliasing filter of FIG. 6 is applied to the n datapoints of the high resolution profile 40 to produce an intermediate filtered profile 42 that is then decimated to produce a final low resolution control profile 45.

Following are two examples of the manner in which the coefficients for the anti-aliasing filters according to the present invention are calculated. In the examples, the filter length is the number of weights in a window and window order is one less than the filter length.

EXAMPLE 1

In the first example, a filter of length 6 with a cutoff frequency of $0.5\pi$ is devised.

Therefore, the Hamming filter coefficients are:

$$w(n)=0.08\delta[n]+0.3979\delta[n-1]+0.9121\delta[n-2]+0.9121\delta[n-3]+0.3979\delta[n-4]+0.08\delta[n-5]$$

The ideal low pass filter coefficients are:

$$h(n)=-0.09\delta[n]+0.1501\delta[n-1]+0.4502\delta[n-2]+0.4502\delta[n-3]+0.1501\delta[n-4]-0.09\delta[n-5]$$

The resulting anti-aliasing filter coefficients are:

$$f(n)=-0.0072\delta[n]+0.0597\delta[n-1]+0.4106\delta[n-2]+0.4106\delta[n-3]+0.0597\delta[n-4]-00072\delta[n-5]$$

Figure 7A:
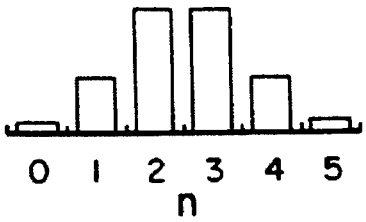
FIGS. 7*a*, 7*b* and 7*c* are impulse response graphs showing Hamming coefficients, ideal low pass filter coefficients and the resulting anti-aliasing filter coefficients, respectively, for a first example of designing a filter according to the present invention.
Figure 7B:
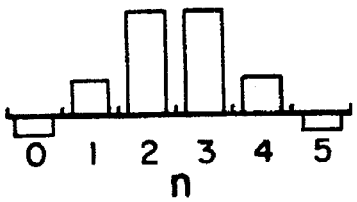
Figure 7C:
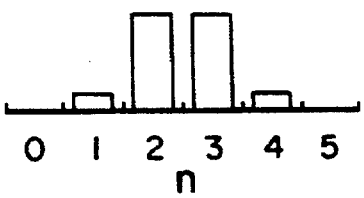

FIGS. 7*a*, 7*b* and 7*c* show the impulse responses of the Hamming filter, the ideal low pass filter and the resulting anti-aliasing filter, respectively.

EXAMPLE 2

In the second example, a filter of length 9 with a cutoff frequency of $0.4\pi$ is devised.

Therefore, the Hamming filter coefficients are:

$$w(n)=0.08\delta[n]+0.2147\delta[n-1]+0.54\delta[n-2]+0.8653\delta[n-3]+\delta[n-4]+0.8653[n-5]+0.54\delta[n-6]+0.2147\delta[n-7]+0.08\delta[n-8]$$

The ideal low pass filter coefficients are:

$$h(n) = -0.757\delta[n] - 0.0624\delta[n-1] + 0.0935\delta[n-2] + 0.3027\delta[n-3] + 0.4\delta[n-4] + 0.3027[n-5] + 0.0935\delta[n-6] - 0.0624\delta[n-7] - 0.0757\delta[n-8]$$

The resulting anti-aliasing filter coefficients are:

$$f(n) = -0.0061\delta[n] - 0.0134\delta[n-1] + 0.0505\delta[n-2] + 0.2619\delta[n-3] + 0.4\delta[n-4] + 0.2619[n-5] + 0.0505\delta[n-6] - 0.0134\delta[n-7] - 0.006\delta[n-8]$$

Figure 8A:
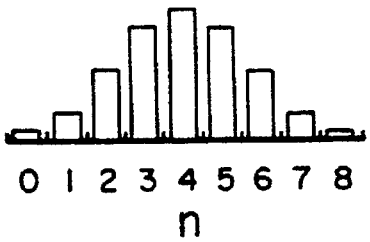
FIGS. 8*a*, 8*b* and 8*c* are impulse response graphs showing calculated Hamming coefficients, ideal low pass filter coefficients and the resulting anti-aliasing filter coefficients, respectively, for a second example of designing a filter according to the present invention.
Figure 8B:
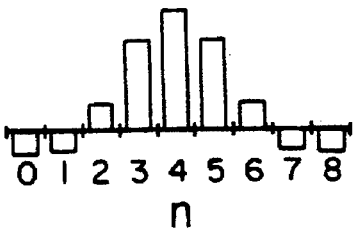
Figure 8C:
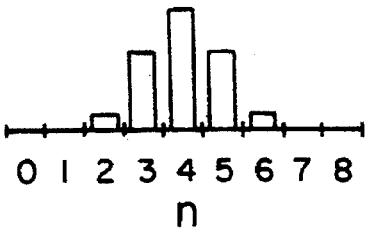

FIGS. 8*a*, 8*b* and 8*c* show the impulse responses of the Hamming filter, the ideal low pass filter and the resulting anti-aliasing filter, respectively.

Figure 9A:
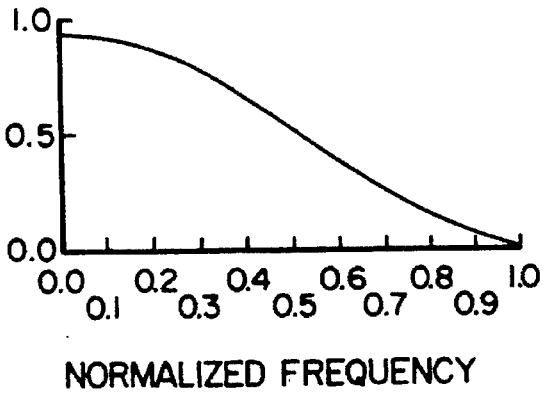
FIGS. 9*a* and 9*b* are graphs showing the magnitude responses of anti-aliasing filters using the coefficients of FIGS. 7*c* and 8*c*, respectively.
Figure 9B:
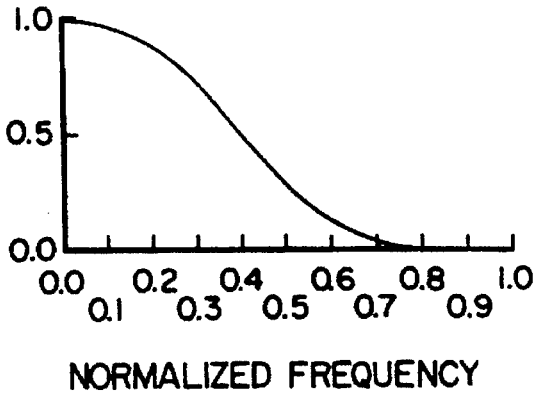

FIG. 9*a* and FIG. 9*b* show the magnitude response of the anti-aliasing filters shown in FIGS. 7*c* and 8*c*, respectively. The response for the filter of FIG. 7*c* has a cutoff frequency of $0.5\pi$ while the response for the filter of FIG. 8*c* has a cutoff frequency of $0.4\pi$. It can be seen that in order to meet the design specification for the first filter, there is much more attenuation in the passband than there is for the second filter. In order to have less attenuation in the passband, a high order of filter is required.

Although the present invention has been described in some detail by way of example for purposes of clarity and understanding, it will be apparent that certain changes and modifications may be practised within the scope of the appended claims.

We claim:

1. A process for transforming a plurality of data points n defining a high resolution profile for a parameter of a sheet material being manufactured into a low resolution profile for control of the parameter comprising the steps of:

filtering the data points of the high resolution profile using an anti-aliasing filter function to create an intermediate profile; and reducing the number of datapoints of the intermediate profile by an integer factor to create the low resolution profile to be used to control the parameter.

2. A process as claimed in claim 1 in which filtering the data points involves applying the function $$f(n)=h(n)w(n)$$

to the n data points of the high resolution profile where f(n) is the anti-aliasing filter function;

w(n) is a Hamming filter function having coefficients determined by the equation $$w(n) = .54 - .46\cos\frac{(2\pi n)}{N} \qquad 0 \leqq n \leqq N$$
$$= 0 \qquad \text{otherwise}$$

where N=the window order of the Hamming function and N is selected by the user; and h(n) is an ideal low pass filter function having coefficients determined by the equation $$h(n) = \frac{\sin\left[\omega_c\left(n-\frac{N}{2}\right)\right]}{\pi\left(n-\frac{N}{2}\right)} \qquad \text{for } n \neq \frac{N}{2}$$
$$= \omega_c \qquad \text{for } n = \frac{N}{2}$$

where $\omega_c$ is the cutoff frequency.

3. A process as claimed in claim 2 in which the cutoff frequency, $\omega_c$, is related to the number of data points in the high resolution profile per data point in the control profile.

4. A process as claimed in claim 3 in which the cutoff frequency is selected according to the equation:

$$\omega_c = \frac{\text{control profile data points}}{\text{high resolution profile datapoints}}\pi - \frac{1}{2}(\Delta\omega)\pi$$

where $\Delta\omega$ is the transition band.

5. A process for controlling a parameter of a sheet material which is being manufactured comprising the steps of:

(a) causing the sheet material to travel;

(b) moving a scanning means across the sheet;

(c) measuring a parameter of the sheet with the scanning means in a plurality of zones, n, which are disposed side-by-side across the sheet to produce a plurality of data points that define a high resolution or mini-slice profile;

(d) filtering the data points using an anti-aliasing filter function to produce an intermediate profile;

(e) reducing the number of data points by an integer factor to create a low resolution or control profile;

(f) controlling the parameter based upon the low resolution profile.

6. A process as claimed in claim 5 in which filtering the data points involves applying the formula $$f(n)=h(n)w(n)$$

to each of the n data points of the high resolution profile where w(n) is a Hamming filter function having coefficients determined by the equation $$w(n) = .54 - .46\cos\frac{(2\pi n)}{N} \qquad 0 \leqq n \leqq N$$
$$= 0 \qquad \text{otherwise}$$

where N=the window order of the Hamming function and N is selected by the user; and h(n) is an ideal low pass filter function having coefficients determined by the equation $$h(n) = \frac{\sin\left[\omega_c\left(n-\frac{N}{2}\right)\right]}{\pi\left(n-\frac{N}{2}\right)} \qquad \text{for } n \neq \frac{N}{2}$$
$$= \omega_c \qquad \text{for } n = \frac{N}{2}$$

where $\omega_c$ is the cutoff frequency.

7. A process as claimed in claim 6 in which the cutoff frequency, $\omega_c$, is related to the number of data points in the high resolution profile per data point in the control profile.

8. A process as claimed in claim 6 in which the cutoff frequency is selected according to the equation:

$$\omega_c = \frac{\text{control profile data points}}{\text{high resolution profile datapoints}}\pi - \frac{1}{2}(\Delta\omega)\pi$$

where $\Delta\omega$ is the transition band.

* * * * *